US005967916A

United States Patent [19]

Robeson

[11] Patent Number: 5,967,916

[45] Date of Patent: Oct. 19, 1999

[54] LAZER BALL

[75] Inventor: John W. Robeson, Virginia Beach, Va.

[73] Assignee: Lazer Ball Technologies, LLC, Virginia Beach, Va.

[21] Appl. No.: 09/018,443

[22] Filed: Feb. 4, 1998

[51] Int. Cl.[6] ..... A63B 37/00

[52] U.S. Cl. ..... 473/600

[58] Field of Search ..... 473/577, 593, 473/594, 600, 601, 602; 273/DIG. 20, DIG. 24

[56] References Cited

U.S. PATENT DOCUMENTS

| | | | |
|---|---|---|---|
| 4,637,616 | 1/1987 | Whiting | 473/577 |
| 5,018,450 | 5/1991 | Smith | 273/DIG. 24 |
| 5,228,697 | 7/1993 | Gulick et al. | 273/DIG. 24 |
| 5,254,379 | 10/1993 | Kotsiopoulos et al. | 473/594 |
| 5,380,002 | 1/1995 | Spector | 473/594 |
| 5,393,054 | 2/1995 | Rouffer | 473/594 |
| 5,470,058 | 11/1995 | Sullivan et al. | 273/DIG. 24 |

*Primary Examiner*—Steven Wong
*Attorney, Agent, or Firm*—Peter A. Borsari

[57] ABSTRACT

The lazer ball is a foamed ball or projectile which glows under particular lighting conditions and which can be fired through a standard air gun, such as a paint ball gun. The lazer ball can be prepared from any suitable foam material which is capable of being molded or extruded into a spherical shape, is compressible when pressure is applied to it and can return to its original shape when pressure is released. Other properties of the lazer ball include a density of between about 11.0 to about 15.0 pcf, a skin thickness of between about 0.015 and about 0.025" and a shore "A" durometer of between about 35.0 and 45.0. A preferred foam material is an integral skin urethane foam system. Standard foam systems may require chemical modification in order to meet the required surface properties.

18 Claims, No Drawings

LAZER BALL

FIELD OF INVENTION

The present invention relates to a foam-type ball which glows in particular lighting conditions, such as a black light atmosphere, and which can be fired through a standard air gun, such as paint ball gun.

BACKGROUND OF THE INVENTION

Games simulating battle and war situations in which players or teams of players compete against opposing members for amusement are well known in the prior art. Such games range from simple board games to children's playing of war to survival games. One type of survival game which has gained in popularity in recent years is the "paint ball" game in which players fire paint balls through air guns at one another. A player who has been contacted by a paint ball is marked with a permanent marker material, typically paint, thereby indicating a score for the opposing team and taking the "hit" player out of the game. There have been significant drawbacks to the paint ball game, including the damaging of the player's clothing by the marking material as well as injuries to the players, including eye damage and severe bruising caused by the impact of the paint ball to the player's body. Nonetheless, numerous paint balls have been developed to enhance various playing situations. For example, U.S. Pat. Nos. 5,018,450 and 5,001,880 to Smith disclose luminescent paint balls for marking nighttime impacts. U.S. Pat. No. 5,393,054 to Rouffer discloses a paint ball comprising a liquid filled gelatin capsule. The paint ball has a density greater than previously known paint balls, enhancing the ballistic characteristics of the paint ball. U.S. Pat. No. 5,590,886 to Lush discloses a reusable paint ball grenade which utilizes a plurality of conventional .68 caliber or smaller paint balls.

Attempts have been made to provide a paint ball or similar type ball which lessens the possibility of injury. For instance, U.S. Pat. No. 5,254,379 to Kotsiopoulos et al. discloses a paint ball having a shell filled with a liquid coloring agent, wherein the shell readily fractures upon striking a person with a decreased risk of cutting, bruising or welting of the skin of the person struck by the ball. In U.S. Pat. No. 4,637,616 to Whiting a ball-shaped marking projectile is disclosed comprising a spherical rubber core, a porous layer having a powdered marking material, and a perforated cover. When the projectile strikes a player, the marking material is dispersed through the perforated cover, providing a less hazardous method of marking an opponent.

Despite the efforts of the prior art, a need still exists for a ball which can be fired through a conventional air gun, such as a paint ball gun, which will neither physically mark the player upon impact nor cause severe bruising. Such a ball should be reusable and should be simple and inexpensive to manufacture.

SUMMARY OF THE INVENTION

Accordingly, it is an object of the present invention to provide a foam-type ball which can be fired through a standard 68-caliber gun, such as a paint ball gun.

It is another object of the present invention to provide a foam-type ball which glows in particular lighting conditions, such as a black light atmosphere.

It is a further object of the present invention to provide a foam-type ball which when fired through a standard paint ball gun appears as tracer rounds.

It is an additional object of the present invention to provide a foam-type ball which can be fired through a standard paint ball gun and is reusable.

It is yet another object of the present invention to provide a foam-type ball which will flatten when pressure is applied to it and will revert to its normal size when pressure is removed from it.

It is still another object of the present invention to provide a foam-type ball which will cause a minor stinging effect to a person upon impact but will not bruise severely like conventional paint balls.

It is an additional object of the present invention to provide a foam-type ball which can be fired through a standard paint ball gun which is easy and inexpensive to manufacture.

These and other objects of the present invention are accomplished by providing a ball composed of a foam material which has been impregnated with a compound which glows in particular lighting conditions.

Additional objects, advantages and novel features of the invention will be set forth in part of the description which follows, and in part will become apparent to those skilled in the art upon examination of the following specification or may be learned by practice of the invention.

DETAILED DESCRIPTION

The present invention relates to a foam-type projectile or ball, hereinafter sometimes referred to as a lazer ball, which glows under particular lighting conditions and which can be fired through a standard air gun, such as paint ball gun. Specific characteristics of the foam material are that it must be capable of being molded or extruded into a spherical shape, it must be compressible when pressure is applied to it and return to its original shape when the pressure is released, and must be compatible with pigments which can glow under particular lighting conditions. More particularly, the resulting lazer ball should have a density of between about 11.0 and about 15.0 pcf (pounds per cubic foot), a skin thickness of between about 0.015 and about 0.025", and a shore "A" durometer (surface firmness) of about 35.0 to 45.0. Foam balls having a density over 15.0 pcf and/or a skin thickness over 0.025" result in too great a mass and the projectile stings or hurts upon contact; balls having a density below about 11.0 pcf have too little mass and cannot maintain a steady trajectory. Similarly, shaped foams having a skin thickness under 0.015" result in balls which are incapable of attaining any velocity or distance. Further, projectiles having a shore "A" durometer over 45.0 do not absorb enough energy, thereby resulting in a hard and painful impact upon contact; lazer balls having a shore "A" durometer under 35.0 collapse in the air gun barrel and drags to the point of losing too much velocity too achieve any distance.

Suitable materials for use as the foam material include, for example, urethane copolymers, polyurethane, aromatic isocyanates, polyurethane/polyether polyol copolymers, aromatic isocyanate/polyol copolymers. Preferably, the foam material used in the present invention is an integral-skin urethane foam system. Integral-skin urethane foam systems have a number of components including polyols, crosslinkers, cell openers, surfactants, fillers, blowing agents and catalysts, all of which constitute the "B" side of the system, commonly referred to as the "poly" side, and also include the "A" side of the system which is the iso or diphenylmethane-4,4'-diisocyanate (MDI). Although there are five basic "isos", MDI is most commonly used in the United States since it is the least toxic. Integral-skin foam systems can be purchased from several suppliers in the United States including Flexible Foam, Burton Polyurethane and Hehr International Polymers, all of Atlanta, Ga. More preferably, the foam system used in the present invention is an open cell aromatic isocyanate/polyether polyol resin material, manufactured by Burton Polyurethane Corporation under its tradename Polymeric MDI, 900 Series A which has been modified as discussed below.

The standard integral-skin foam systems noted above must be modified in order to attain the required properties of the resulting lazer ball. Without modification, these standard foam systems form very thick skins resulting in higher than desired densities, thereby making the projectile painful upon impact. In addition, another problem with the standard systems is the percentage of open cells. Typically, the standard system is composed of about 80% closed cells which results in too much rebound of the resulting projectile (i.e. the ball does not compress and feels solid). Accordingly, the standard integral skin foam systems must be chemically modified in order to reduce the amount of closed cells and to reduce the overall density of the resulting projectile.

Any suitable chemical modification which reduces the percentage of closed cells in a standard integral skin foam system may be used in practicing the present invention. One such method is to modify the amount of crosslinker in the poly or "B" side of the system. Typical crosslinkers utilized in these systems are ethylene glycol, (EG), butanediol and trimethylol propane. In Burton Polyurethane's #900 foam system, it was found that reducing the amount of ethylene glycol by about 30%, sufficiently reduced the percentage of closed cells to obtain a projectile having suitable compressibility. Various methods also are known in the art to reduce the amount of skin developed in standard foam systems, including, for example, the addition of surfactants, solvents and/or water to the "B" side of the foam system. In the present invention, it was discovered that the addition of about 3/100 parts of water to the poly side of the system offset the amount of skin formed by the system, thereby lowering the overall density of the molded projectile. Although two methods of modifying a standard integral skin foam system are disclosed, it is to be understood that any modifications of an integral skin foam system which attains the desired density, skin thickness and shore "A" durometer are well within the scope of the present invention.

The foam system is impregnated with a pigmented material which is capable of glowing under desired lighting. Such a material may be, for example, fluorescent, phosphorescent or luminescent. Preferably, the material is a fluorescent pigment which will glow in a black light atmosphere, numerous such pigments being well known in the prior art. In a preferred embodiment, the fluorescent pigment is added to a dispersing material, such as diisononylphthlate (DINP) which provides a concentrate of fluorescent pigment which can be admixed easily into a poly-system, such as a urethane foam system. The use of a dispersing system enables the pigment to be conveniently stirred into the poly-system without problems of pigment "fly up", or dusting typically encountered when handling the dry powder forms of these pigments. The fluorescent coloring pigment can be any color, for example, yellow, red, pink, rose, orange, green, blue and the like.

The urethane foam system having the pigment admixed therewith is molded or extruded into a plurality of spherical shapes, projectiles or balls and cured. Preferably, the urethane foam/pigment system is poured into molds dimensioned to produce .68 caliber size foam balls.

The following example illustrates a preferred embodiment of the present invention.

EXAMPLE 1

The integral skin foam system used was Burton Polyurethane's #900 system.

100 parts/weight of the poly "B" side was modified by removing 2/10 parts/weight (30%) of ethylene glycol therefrom and adding 3/100 parts/weight water.

62 parts/weight of the iso "A" side (MDI) were admixed with 100 parts/weight of the modified "B" side.

5.52 parts/weight of a fluorescent yellow dispersion obtained from Cardinal Color, Inc. identified as DI-4242 were added to the foam system.

The mixture was stirred for approximately 12 seconds and poured into a mold for forming the lazer balls. The mold used was a 144 cavity mold. The mold was pre-heated to 110° C. prior to receiving the admixture.

The poured mixture was allowed to set for approximately 5 minutes and the resulting foamed fluorescent balls were removed from the molds. The resulting balls were fired from a standard .68 caliber air gun and found to have the proper density, skin thickness, compressibility and shore "A" durometer properties.

Using the same process of making the foam balls as set forth in Example 1, different foam systems were tested in each of following Examples 2–12.

| Example/ Foam System | "A" side (pts/wt) | "B" side (pts/wt) | Results |
|---|---|---|---|
| Ex 2: FP-390[1] | 42.0 | 100.0 | poor tensile core |
| Ex 3: FP-390 | 45.0 | 100.0 | good tensile, good density, too hard |
| Ex 4: FP-390 | 43.0 | 100.0 | poor tensile, good density |
| Ex 5: HI-1208[2] | 42.0 | 100.0 | poor tensile, low density |
| Ex 6: HI-1208 | 45.0 | 100.0 | poor tensile, good density |
| Ex 7: BP-900[3] | 60.0 | 100.0 | good tensile, good durometer, too soft |
| Ex 8: BP-900 | 62.0 | 100.0 | good tensile, good durometer, too hard |
| Ex 9: BP-900[4] | 60.0 | 100.0 | good tensile, good durometer, high density, too hard |
| Ex 10: BP-900[5] | 59.0 | 100.0 | good tensile, good durometer, high density, too hard |
| Ex 11: BP-900[6] | 59.0 | 100.0 | good tensile, good durometer, high density, too hard |
| Ex 12: BP-900[7] | 59.0 | 100.0 | good tensile, good durometer, good density, too hard |

[1]Flexible Products Foam System #390
[2]Hehr International Foam System #1208
[3]Burton Polyurethane Foam System #900
[4]Burton Polyurethane Foam System #900, modified with addition of 3/10 pt/wt EG
[5]Burton Polyurethane Foam System #900, modified with addition of 2/10 pt/wt EG
[6]Burton Polyurethane Foam System #900, modified with addition of 2/10 pt/wt EG and 2/100 pt/wt of silicone surfactant
[5]Burton Polyurethane Foam System #900, modified with addition of 2/10 pt/wt EG and 2/100 pt/wt of silicone surfactant and 2/10 cyclopentane The LazerBall pursuit game is played in the same manner as conventional paint ball games, such as "Capture the Flag". As the balls do not leave a mark on an opponent player when fired from the air gun, it is contemplated that the balls of the present invention will be used in association with particular clothing to be worn by all players in the game. A preferred type of clothing would be designed with pressure sensitive sensors which would register the impact of the ball when a player is struck by an opponent. Preferably, such a clothing article would be capable of recording where on the player's body the impact occurred and would score the impact as a major injury, a minor injury or a kill. However, such specialty attire is not a requirement for playing the LazerBall game. Rather, the game is based on an honor system which requires that when a player is "hit", he calls himself out of the game.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A foamed ball composed from a composition comprising (a) a foam material, (b) a catalyst and (c) a pigment material capable of glowing under particular lighting conditions, wherein said foamed ball has a density of between about 11.0 and about 15.0 pcf, a skin thickness of about 0.015 to about 0.025" and a shore "A" durometer of about 35.0 to about 45.0, said foamed ball being capable of use as a projectile in an air gun.

2. A foamed ball in accordance with claim 1, wherein said foam material is selected from the group consisting of polyurethane, urethane copolymers, aromatic isocyanates, polyurethane/polyether polyol copolymers and aromatic isocyanate/polyol copolymers.

3. A foamed ball in accordance with claim 1, wherein said foam material is an integral skin urethane foam system.

4. A foamed ball in accordance with claim 1, wherein said pigment material is selected from the group consisting of fluorescent pigments, phosphorescent pigments and luminescent pigments.

5. A foamed ball in accordance with claim 4, wherein said pigment material is a fluorescent pigment which glows in a black light atmosphere.

6. A foamed ball in accordance with claim 5, wherein said fluorescent pigment is concentrated in a dispersing material.

7. A foamed ball in accordance with claim 6, wherein said dispersing material is diisononylphthlate.

8. A foamed ball in accordance with claim 3, wherein said foam system is an aromatic isocyanate/polyether polyol resin system.

9. A foamed ball prepared from an integral skin urethane foam system comprising:

(a) 100 parts by weight of the poly "B" component;

(b) 59 to 62 parts by weight of the iso "A" component; and (c) 4 to 6 parts by weight of a pigment material capable of glowing under particular lighting conditions, wherein said foamed ball has a density of between about 11.0 and about 15.0 pcf, a skin thickness of about 0.015 to about 0.025" and a shore "A" durometer of about 35.0 to about 45.0.

10. A foamed ball in accordance with claim 1, wherein said pigment material is selected from the group consisting of fluorescent pigments, phosphorescent pigments and luminescent pigments.

11. A foamed ball in accordance with claim 4, wherein said pigment material is a fluorescent pigment which glows in a black light atmosphere.

12. A foamed ball in accordance with claim 5, wherein said fluorescent pigment is concentrated in a dispersing material.

13. A foamed ball in accordance with claim 6, wherein said dispersing material is diisononylphthlate.

14. A foamed ball prepared from an integral skin urethane foam system comprising:

(a) 59 to 62 parts by weight of a diphenyl-4,4'-diisocyanate as the "A" component;

(b) 100 parts by weight of a "B" component comprising polyols, crosslinkers, cell openers, surfactants, fillers, blowing agents and catalysts; and (c) 4 to 6 parts by weight of a pigment material capable of glowing under particular lighting conditions, wherein said foamed ball has a density of between about 11.0 and about 15.0 pcf, a skin thickness of about 0.015 to about 0.025" and a shore "A" durometer of about 35.0 to about 45.0.

15. A foamed ball in accordance with claim 1, wherein said pigment material is selected from the group consisting of fluorescent pigments, phosphorescent pigments and luminescent pigments.

16. A foamed ball in accordance with claim 4, wherein said pigment material is a fluorescent pigment which glows in a black light atmosphere.

17. A foamed ball in accordance with claim 5, wherein said fluorescent pigment is concentrated in a dispersing material.

18. A foamed ball in accordance with claim 6, wherein said dispersing material is diisononylphthlate.

* * * * *